US009464770B2

(12) United States Patent
Morgan

(10) Patent No.: US 9,464,770 B2
(45) Date of Patent: Oct. 11, 2016

(54) LED LIGHTING STRIP

(71) Applicant: David Morgan, London (GB)

(72) Inventor: David Morgan, London (GB)

( * ) Notice: Subject to any disclaimer, the term of this patent is extended or adjusted under 35 U.S.C. 154(b) by 0 days.

(21) Appl. No.: 14/356,491

(22) PCT Filed: Nov. 6, 2012

(86) PCT No.: PCT/GB2012/000831

§ 371 (c)(1),
(2) Date: May 6, 2014

(87) PCT Pub. No.: WO2013/068714

PCT Pub. Date: May 16, 2013

(65) Prior Publication Data

US 2014/0313721 A1 Oct. 23, 2014

(30) Foreign Application Priority Data

Nov. 7, 2011 (GB) ..... 1119163.2

(51) Int. Cl.
*F21S 4/00* (2016.01)
*F21V 21/005* (2006.01)
(Continued)

(52) U.S. Cl.
CPC ..... *F21S 4/003* (2013.01); *F21S 4/20* (2016.01); *F21S 4/28* (2016.01); *F21V 21/005* (2013.01); *F21V 23/06* (2013.01); *F21V 29/83* (2015.01); *F21Y 2101/02* (2013.01); *F21Y 2103/003* (2013.01)

(58) Field of Classification Search
CPC ..... F21S 4/003; F21S 4/008; F21S 2/005; F21V 21/005; F21V 23/06; F21V 29/83; F21V 29/2293; F21V 21/30; F21V 14/02; F21Y 2101/02; F21Y 2103/003; F21K 9/00
USPC ..... 362/249.01, 249.03; 248/181.1, 181.2, 248/288.31, 160
See application file for complete search history.

(56) References Cited

U.S. PATENT DOCUMENTS 3,188,794 A 6/1965 Johnson
5,562,357 A * 10/1996 Sandell ..... 403/122
(Continued)

FOREIGN PATENT DOCUMENTS

EP 0506354 A1 9/1992
WO WO 03058114 A1 7/2003

OTHER PUBLICATIONS

United Kingdom Search Report dated May 16, 2012, for United Kingdom Patent Application No. GB 1119163.2.
(Continued)

*Primary Examiner* — Jason Moon Han
*Assistant Examiner* — Omar Rojas Cadima
(74) *Attorney, Agent, or Firm* — Thomas & Karceski, PC

(57) ABSTRACT

An electric lighting arrangement including a plurality of lighting units each containing a plurality of LED lights, to form a strip of lights. The units are adapted to be joined together by means of a ball joint arrangement, which comprises two conjoined balls, each ball being adapted to be mounted in a retaining bail cup in a lighting unit, ball cups being provided on opposed ends of the units to enable the units to be pivotable one relative to the other in all planes. Each lighting unit includes a main body incorporating a heat sink in the form of head conducting fins.

11 Claims, 4 Drawing Sheets

(51) Int. Cl.

| | |
|---|---|
| ***F21V 23/06*** | (2006.01) |
| ***F21V 29/83*** | (2015.01) |
| *F21Y 101/02* | (2006.01) |
| *F21Y 103/00* | (2016.01) |

(56) References Cited

U.S. PATENT DOCUMENTS

| | | | | |
|---|---|---|---|---|
| 7,036,962 | B2 * | 5/2006 | Chan | 362/407 |
| 7,165,863 | B1 | 1/2007 | Thomas et al. | |
| 2003/0063463 | A1 * | 4/2003 | Sloan et al. | 362/238 |
| 2009/0168422 | A1 | 7/2009 | Chiu et al. | |

OTHER PUBLICATIONS

International Search Report dated Apr. 22, 2014, for International Patent Application No. PCT/GB2012/000831.

* cited by examiner

LED LIGHTING STRIP

CROSS-REFERENCE TO RELATED APPLICATION(S)

This is a National Stage Entry into the United States Patent and Trademark Office from International PCT Patent Application No. PCT/GB2012/000831, having an international filing date of Nov. 6, 2012, and which claims priority to United Kingdom Patent Application No. GB 1119163.2, filed Nov. 7, 2011, the entire contents of both of which are incorporated herein by reference.

FIELD OF THE INVENTION

The present invention relates to lighting arrangements, particularly but not exclusively, for providing distinctive lighting patterns to areas such as auditoria, commercial reception areas public spaces and hotel lounges.

DESCRIPTION OF THE RELATED ART

In such large areas there is a requirement for lighting systems which, particularly when dealing with complex shaped spaces, require a significant amount of flexibility to enable the light to be directed in the direction and with the intensity required for the desired lighting effect. Typically, a solution to this problem is achieved by individually designing and assembling a bespoke lighting system for each installation. Such an installation is therefore almost inevitably extremely expensive to design, manufacture and install.

SUMMARY OF THE INVENTION

The present invention seeks to provide a solution to this problem by providing lighting units which can be rapidly assembled into a lighting arrangement to provide the required amount of light and to enable the individual lights to be directed in the required direction substantially independently of the other light units in the system. Such systems typically include a large number of lighting elements which generate a great deal of heat, and the present invention also seeks to provide an arrangement to facilitate the removal of heat from the units According to the present invention there is provided an electric lighting arrangement including at least two lighting units each containing at least one light source, the units being adapted to be joined together by means of a universal joint mechanism to enable the units to be pivotable one relative to the other in all planes. wherein each lighting unit includes a main body incorporating a heat sink in the form of heat conducting fins.

In a preferred embodiment, the fins are formed integrally with the main body.

In a preferred arrangement each unit has a plurality of light sources, and the light sources may be arranged linearly along the length of the unit. The unit is preferably elongate and the light sources are preferably arranged along the longitudinal axis of the unit.

Advantageously, the light sources are LEDs.

In a preferred embodiment, the universal joint mechanism comprises a ball joint arrangement, which preferably comprises two conjoined balls, each ball being adapted to be mounted in a retaining ball cup in a lighting unit, ball cups being provided on opposed ends of the unit.

Preferably, the or each ball joint arrangement has a through bore through which a power cable passes to provide power to the light sources.

In a preferred arrangement, a plurality of said lighting units are adapted to be joined together to form a strip of lights.

Preferably, a common power cable passes through all the units, power for the individual light sources being tapped from the power cable.

In an alternative embodiment, the ball joints are a snap fit in the associated ball cup the ball joints and ball caps may be formed of a synthetic plastics material. In a further improvement, the balls and associated cups include electrical contacts through which the light sources are electrically connected to a power source.

BRIEF DESCRIPTION OF THE DRAWINGS

Preferred embodiment of the present invention will now be described by way of example with reference to the accompanying drawings, in which:—

DETAILED DESCRIPTION OF EMBODIMENT(S) OF THE INVENTION

Figure 1:
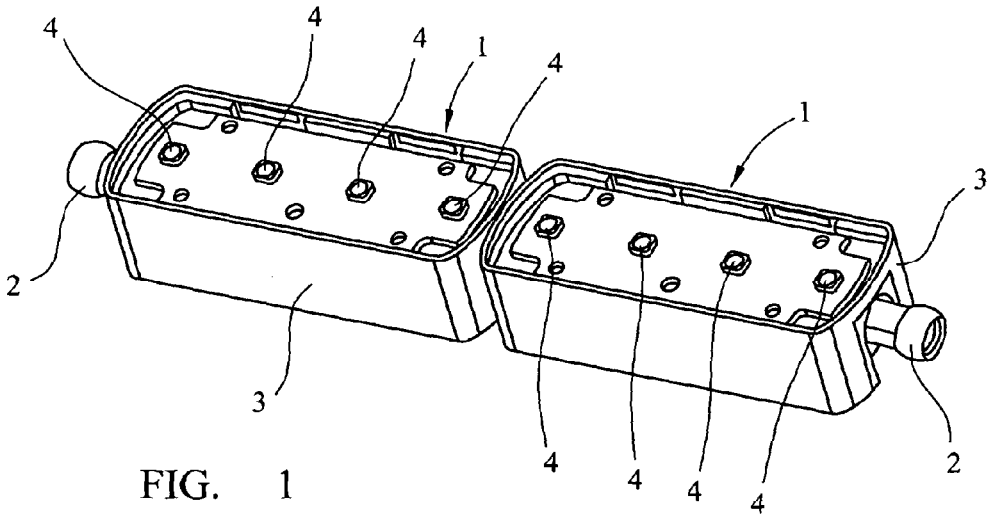
FIG. 1 shows a perspective view of two conjoined lighting units of a lighting arrangement.
Figure 2:
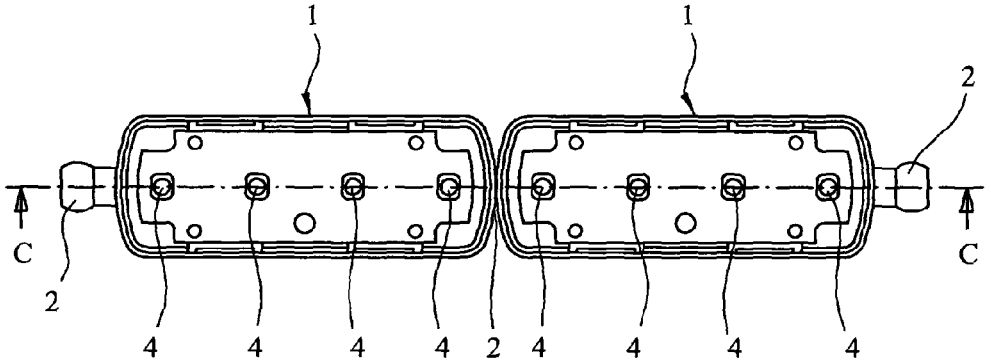
FIG. 2 shows a plan view of FIG. 1.

Referring now to FIGS. 1-4, there is shown an embodiment of a lighting arrangement consisting of two lighting units 1 joined together by a ball joint arrangement 2. Each lighting unit 1 consists of a main body 3 in the form of an elongate holder having mounted on one face a series of linearly aligned light sources 4 in the form of LEDs mounted on a plate which is secured to the main body 1. As shown in FIG. 2, the light sources 4 are linearly aligned along the central axis of the light units 1. The main body 3 also forms a heat sink to assist in dissipating the heat generated by the light sources 4 in use.

The electrical wiring for the lights, and a power cable are contained, in use, within the main body 3 but are not shown. The opposite face of the main body to the light sources is closed by a retaining plate 5.

Figure 3:
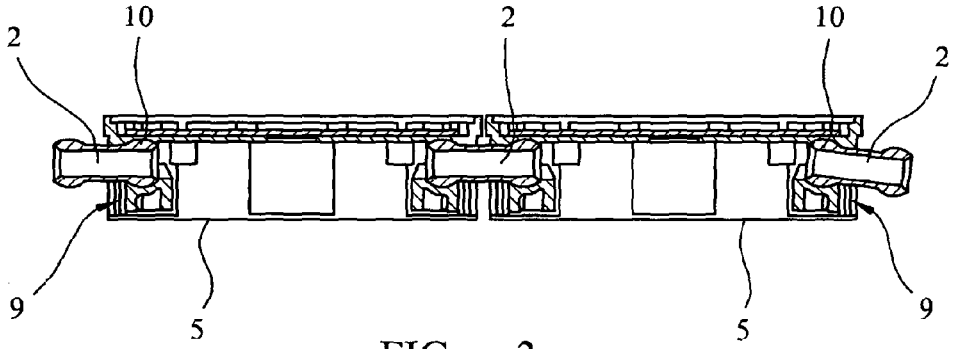
FIG. 3 shows a sectional view along the line CC of FIG. 2.
Figure 4:
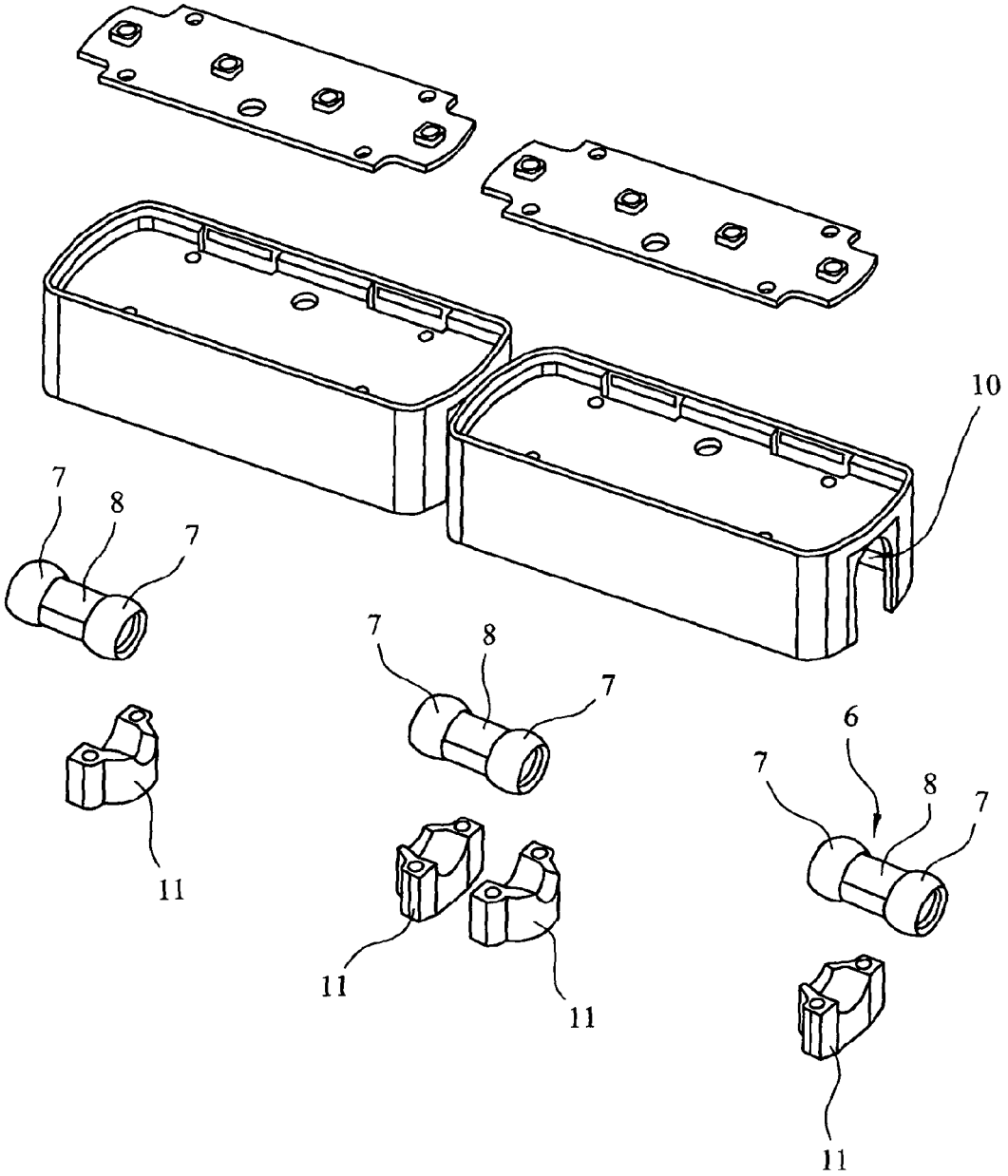
FIG. 4 shows an exploded view of FIG. 1.
Figure 5:
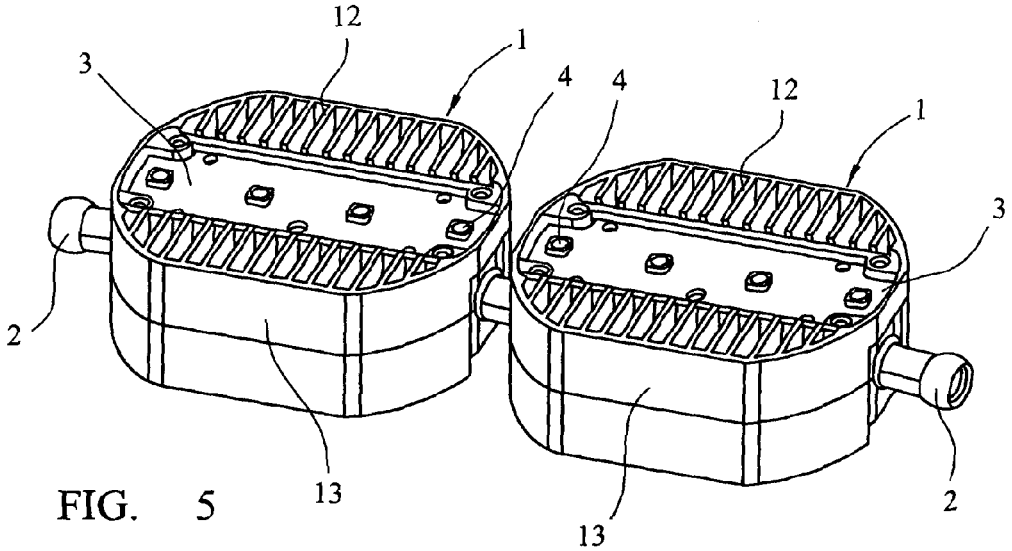
FIG. 5 shows a perspective you of a further embodiment of two conjoined lighting units.
Figure 6:
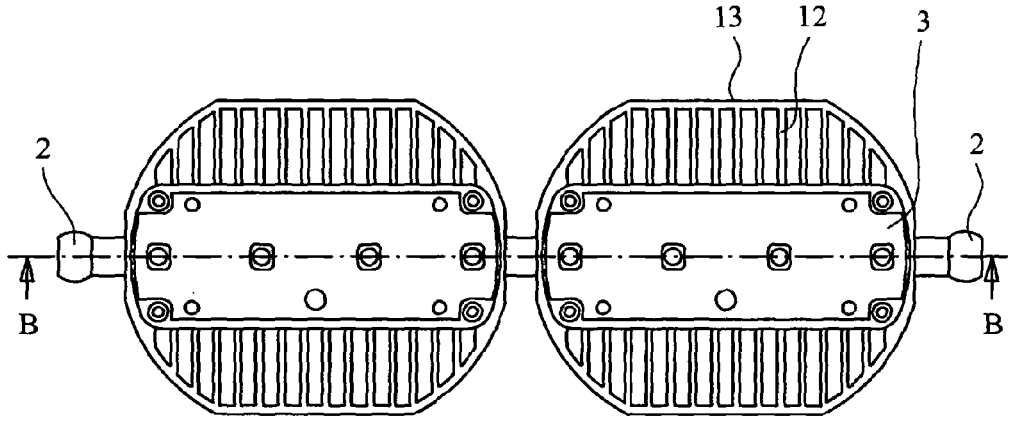
FIG. 6 shows a plan view of FIG. 1.
Figure 7:
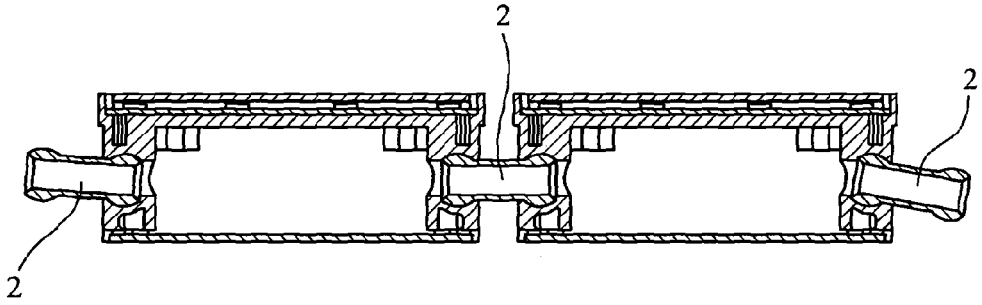
FIG. 7 shows a cross-sectional view along the line BB of FIG. 6.
Figure 8:
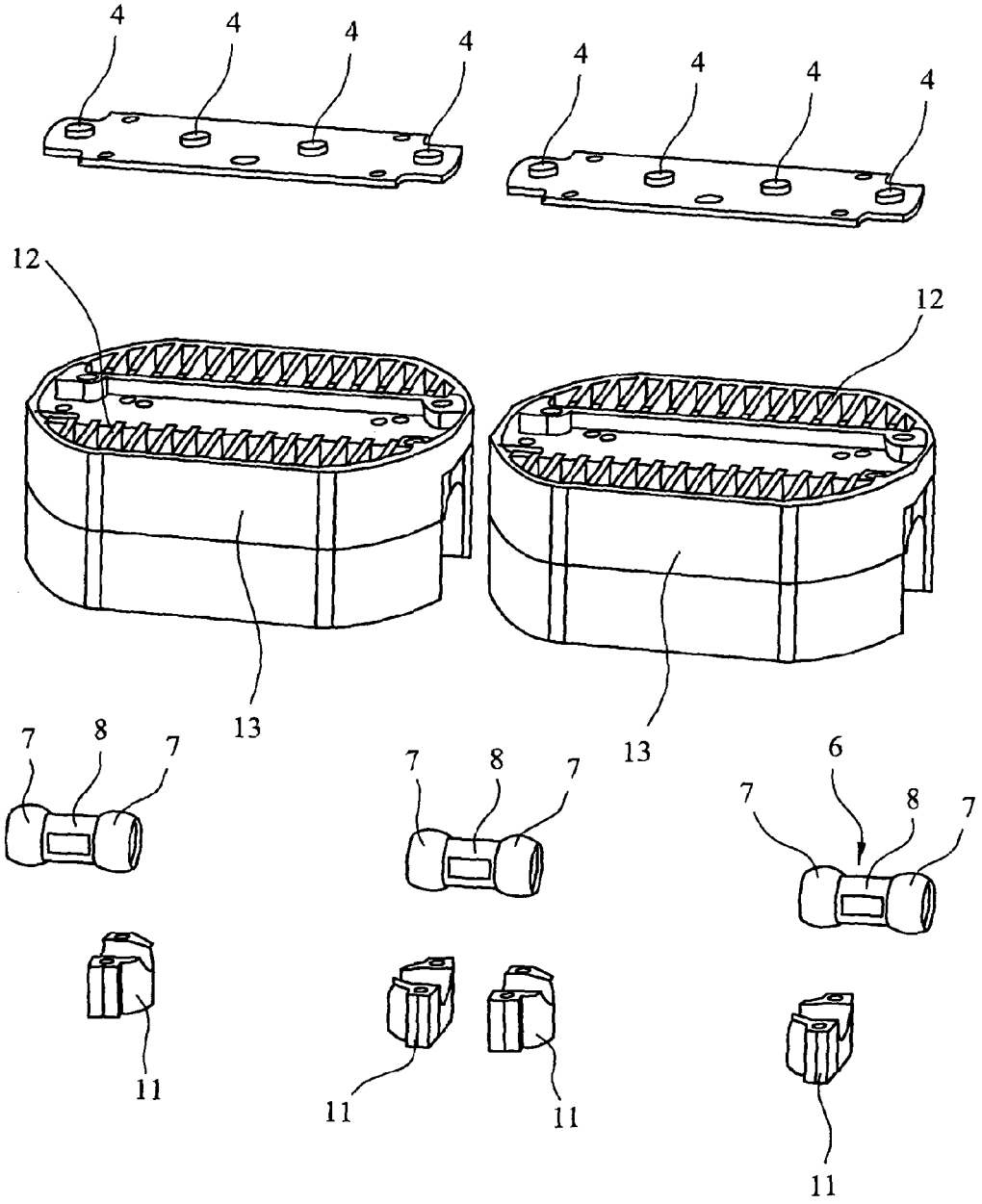
FIG. 8 shows an exploded view of FIG. 5.

As shown particularly in FIGS. 3 and 4, the two light units 1 are adjoined by a ball joint arrangement 2 each of which comprises a pair 6 of conjoined balls 7 the balls 7 being spaced by a short joining sleeve 8. Each ball 7 is adapted to be pivotally retained in a ball cup 9 located in the end of an associated one of the light units 1. The ball cup 9 consists of a first part 10 formed in or secured to the main body 3 and a second part in the form of a closure cap 11 secured by screws to the first part 10 to retain the ball 7 in the cup in such a way as to enable the ball 7 to pivot relative to the main body 3 in all planes.

A second light unit 1 is secured to the other ball 7 of the ball arrangement 2 to thus secure the two light units together so that they are pivotable one relative to the other in all planes. It can thus be seen that a plurality of light units can be secured together to form a long strip of lights. Sufficient friction is provided in the pivotal engagement so that the two units remain in the orientation set by the installer but can be readily adjusted manually to the required position Referring now to FIGS. 5-8 there is shown a modified embodiment in which like parts bear like references. This embodiment is identical in construction to that shown in FIGS. 1-4 except that the main body 3 incorporates a heat sink in the form of fins 12 which dissipate heat generated by the light sources. In one form the fins 12 are formed on a separate body which is secured to the main body 3 but, in an alternative embodiment are, formed integrally with the main body which may be formed of a one piece alloy diecasting, for example.

In an alternative arrangement, not shown in the drawings, the ball joint arrangement 2 and the associated cups 9 are formed of a synthetic plastics material, which is electrically non-conductive. In such an arrangement the ball cup is an integral unit which is secured to the main body and the balls 7 are a snap fit in the cups 9. Such an arrangement would facilitate assembly of a plurality of the light units. It is envisaged that the light sources of each unit may be hard-wired and the light sources connected to electrical contacts on the cups which are automatically engaged by contacts on the balls, when units are joined together, to form an electrical path to an external power source.

In a further embodiment (not shown), the retaining ball cups may consist of a fixed hemispherical base part secured in the unit into which the ball can be inserted, with a retaining ring having a part spherical inner face engaging the ball and being retained in position by means of a circlip or threaded ring to thereby secure the ball to the unit.

The invention claimed is:

1. An electric lighting arrangement, comprising:

at least two lighting units, wherein each lighting unit comprises a main body, at least one LED contained therein, and a heat sink incorporated into the main body, wherein the heat sink comprises heat conducting fins; and a universal joint mechanism joining the at least two lighting units to each other, the universal joint mechanism comprising a ball joint arrangement, each ball joint arrangement having two conjoined balls spaced by a joining sleeve and a retaining ball cup located in an associated lighting unit, the retaining ball cup having a first part formed in or secured to the main body of the associated lighting unit and a closure cap secured by screws to the first part to retain a conjoined ball in the cup;

wherein the universal joint mechanism enables the units to be pivotable one relative to the other in all planes from at least a first predetermined orientation to a second predetermined orientation, and wherein the universal joint mechanism frictionally maintains the at least two lighting units in the first predetermined orientation until the at least two lighting units are adjusted manually to the second predetermined orientation.

2. An electric lighting arrangement according to claim 1, wherein, for each lighting unit, the heat conducting fins are formed integrally with the main body.

3. An electric lighting arrangement according to claim 1, wherein each lighting unit has a plurality of LEDs.

4. An electric lighting arrangement according to claim 3, wherein each lighting unit is elongate and the plurality of LEDs are arranged linearly along a length of each lighting unit.

5. An electric lighting arrangement according to claim 1, wherein the retaining ball cups are provided on opposed ends of each lighting unit.

6. An electric lighting arrangement according to claim 5, wherein the or each ball joint arrangement has a through bore through which a power cable passes to provide power to the LEDs.

7. An electric lighting arrangement according to claim 1, wherein a plurality of the lighting units are joined together to form a strip of lighting units.

8. An electric lighting arrangement according to claim 7, wherein a common power cable passes through all of the lighting units and wherein the LEDs tap power from the power cable.

9. An electric lighting arrangement and according to claim 5, wherein the conjoined balls snap fit in the associated retaining ball cups.

10. An electric lighting arrangement according to claim 9, wherein the conjoined balls and the retaining ball cups are formed of a synthetic plastics material.

11. An electric lighting arrangement as claimed in claim 9, wherein the conjoined balls and associated retaining ball cups include co-operating electrical contacts through which the LEDs are electrically connected to a power source.

* * * * *